US005815076A

United States Patent [19]

Herring

[11] Patent Number: 5,815,076

[45] Date of Patent: Sep. 29, 1998

[54] PULSED-SIGNAL MAGNETOMECHANICAL ELECTRONIC ARTICLE SURVEILLANCE SYSTEM WITH IMPROVED DAMPING OF TRANSMITTING ANTENNA

[75] Inventor: Richard L. Herring, Coconut Creek, Fla.

[73] Assignee: Sensormatic Electronics Corporation, Boca Raton, Fla.

[21] Appl. No.: 585,498

[22] Filed: Jan. 16, 1996

[51] Int. Cl.[6] ..... G08B 13/14

[52] U.S. Cl. ..... 340/572; 455/78

[58] Field of Search ..... 340/572; 455/78

[56] References Cited

U.S. PATENT DOCUMENTS

| | | | |
|---|---|---|---|
| 3,889,263 | 6/1975 | Johannessen | 342/388 |
| 4,510,489 | 4/1985 | Anderson, III et al. | 340/572 |
| 4,933,638 | 6/1990 | Kenyon et al. | 324/303 |
| 5,025,492 | 6/1991 | Viereck | 340/572 X |
| 5,365,235 | 11/1994 | Kennedy et al. | 455/78 X |

*Primary Examiner*—Thomas Mullen

*Attorney, Agent, or Firm*—Robin, Blecker, Daley and Driscoll

[57] ABSTRACT

In a pulsed-signal magnetomechanical electronic article surveillance system, a single transmit circuit is used to drive two or more parallel-connected interrogation signal transmitting antennas. One or more switchable damping circuits are provided in series with the antennas to promote rapid damping of the interrogation signal at the end of each signal pulse. The damping circuit or circuits are situated to provide damping in the loop or loops formed by the parallel-connected antennas. Each switchable damping circuit is formed of a resistance connected between a respective antenna and a terminal of the transmit circuit, as well as a switching element connected across the resistance. The switching element is maintained in a conducting condition during each signal pulse and is open-circuited at the end of each pulse to bring the resistance into effective damping connection with the transmit antennas.

21 Claims, 6 Drawing Sheets

PULSED-SIGNAL MAGNETOMECHANICAL ELECTRONIC ARTICLE SURVEILLANCE SYSTEM WITH IMPROVED DAMPING OF TRANSMITTING ANTENNA

FIELD OF THE INVENTION

This invention relates to electronic article surveillance (EAS) systems, and, more particularly, to EAS systems which utilize pulsed interrogation signals to excite magnetomechanical EAS markers.

BACKGROUND OF THE INVENTION

It is known to provide electronic article surveillance systems to prevent or deter theft of merchandise from retail establishments. In general, in such systems, markers designed to interact with an electromagnetic field placed at the store exit are secured to articles of merchandise. If a marker is brought into the field or "interrogation zone", the presence of the marker is detected and an alarm is generated. If proper payment for the article of merchandise is made, then either the marker is removed from the article at the checkout counter, or the marker is deactivated by changing an operating characteristic of the marker so that it will no longer be detectable at the interrogation zone.

A particularly effective type of EAS system utilizes magnetomechanical markers. Such markers include an active magnetic element that, in the presence of a suitable magnetic bias field, can be excited into magnetomechanical resonance by an alternating interrogation signal provided at the active element's natural resonant frequency. U.S. Pat. No. 4,510,489, issued to Anderson, III, et al., discloses magnetomechanical EAS systems and markers used therein. The disclosure of the '489 patent is incorporated herein by reference. Magnetomechanical EAS systems in which the interrogation signal is transmitted in pulses or bursts are in widespread use, and are distributed by the assignee of the present application under the trademark "ULTRA*MAX".

FIG. 1 illustrates in block-diagram form a pulsed-signal magnetomechanical EAS system, indicated generally by the reference numeral 10.

The EAS system 10 operates with a marker 12 and includes a synchronizing circuit 14, a transmit circuit 16 and a receiver circuit 22 both connected to the synchronizing circuit 14, a transmit antenna 18 to be energized by the transmit circuit 16, and a receiver antenna 20 for receiving signals in the interrogation zone and providing such signals to the receiver circuit 22. An indicator device 24 is connected to the receiving circuit 22.

The operations of the transmit circuit 16 and the receiver circuit 22 are controlled by the synchronizing circuit 14. The synchronizing circuit 14 sends a synchronizing gate pulse to the transmit circuit 16 which activates the transmit circuit 16. Upon being activated, the transmit circuit 16 generates and sends an interrogation signal (typically at 58 KHz) to the transmit antenna 18 for the duration of the synchronizing pulse. An interrogating magnetic field generated by the antenna 18 excites the marker 12 into mechanical resonance. Upon completion of the interrogation signal, the synchronizing circuit 14 sends a gate pulse to the receiver circuit 22, and the gate pulse activates the receiver circuit 22. During the period that the receiver circuit 22 is activated, the marker 12, if present in the interrogation zone, will generate a signal at the frequency of mechanical resonance of the marker in receiver antenna 20. When the marker frequency is sensed by the receiver circuit 22, the receiver 22 applies a signal to the indicator device 24, which records the presence of the marker 12, produces an alarm indication, or initiates other appropriate action.

FIG. 2 is an isometric view showing components of the marker 12. As seen from FIG. 2, the marker 12 includes an elongated, ductile magnetostrictive ferromagnetic strip 26, which is sometimes referred to as the "active element" of the marker 12. The active element 26 is housed within a hollow recess 28 formed in a housing structure 30. A biasing magnetic element 32, formed of a hard ferromagnetic substance, is mounted in proximity to the recess 28 which contains the active element 26.

As will have been understood from the foregoing description of the EAS system 10, the synchronizing circuit 14 operates so that the receiver circuit 22 "listens" for the signal radiated by the marker 12 during "quiet" periods in between the pulses of the interrogation field generated through the transmit antenna 18. Efficient operation of this type of system requires that the antenna 18 have a high Q, and it follows that the antenna 18 tends to continue radiating the interrogation field signal after the time at which it is attempted to end the pulse of the interrogation field signal by ceasing to energize the antenna 18 via the transmit circuit 16. It will be understood that the system 10 is operable only to the extent that the transmit antenna 18 rings down more rapidly than the magnetomechanical resonance of the marker 12, since the receiver circuit 22 cannot be allowed to listen for marker signals until after radiation of the interrogation field pulse by transmit antenna 18 has effectively ceased. Accordingly, it is desirable that the transmit antenna 18 ring down quickly, so that the marker 12 is still generating a resonant signal of substantial amplitude at the time when the receiver circuit 22 is activated.

Two techniques have been employed to damp the transmit antenna. According to the first, the transmit circuit effectively becomes a large impedance in series with the antenna when the interrogation signal pulse concludes. However, clamping by the transmitter voltage rails limits the amount of damping provided by the transmit circuit. It is also known to use the transmit circuit to drive the antenna out of phase with the interrogation signal, in order to provide active damping, at the conclusion of the interrogation signal pulse. With either of these known techniques, antenna ring-down continues over a period that is significant relative to the marker ring-down.

The need to have rapid ring down of the transmit antenna 18 at the end of the interrogation signal pulse has presented particular problems when it was desired to drive more than one antenna 18 from a single transmitting circuit 16. It has not been practical to connect two or more antennas in parallel for driving by a single transmit circuit 16, because the loop formed by the parallel-connected antennas is free of the impedance represented by the transmit circuit and therefore is subject to an extended period of ringing at the end of the interrogation signal pulse. Consequently, in cases where it has been desired to drive more than one antenna with a single transmit circuit, two antennas have been provided in series connection with the transmit circuit. However, such an arrangement produces a lower driving current for the antennas than would be provided if only a single antenna were connected to the transmit circuit. In order to arrange that the transmit circuit will provide the desired current level whether driving a single antenna or two antennas connected in series, it has been the practice to arrange the transmit circuit so as to produce a voltage appropriate for driving two antennas, and, when only one antenna is to be driven by the transmit circuit, a power resistor is connected in series with the single antenna in order to reduce the current provided to the antenna to the desired level. It is evident that such an arrangement is quite inefficient in single antenna installations because of the power dissipated by the resistor. The inefficiencies of this prior art practice would be still greater if it were desired to provide a transmit circuit capable of optionally driving either three or more antennas in series or a smaller number of antennas.

Also, the known series-connected multiple-antenna arrangement is not free of ring-down problems. If there are differences in the resonant frequencies of the antennas, the resulting phase differences tend to increase the effective ring-down time.

OBJECTS AND SUMMARY OF THE INVENTION

It is accordingly an object of the invention to provide a pulsed-signal magnetomechanical electronic article surveillance system in which a single driving circuit can be used to efficiently drive either one antenna or a plurality of antennas.

It is a further object of the invention to provide a pulsed-signal magnetomechanical electronic article surveillance system in which a transmit antenna or antennas are rapidly damped at the end of interrogation signal pulses.

According to an aspect of the invention, there is provided a pulsed-signal magnetomechanical electronic article surveillance system, including a signal generating circuit for selectively generating an alternating interrogation signal, a transmitting antenna connected to the signal generating circuit for receiving the alternating interrogation signal and radiating the alternating interrogation signal into an interrogation zone, a switchable damping circuit connected to the antenna and including an impedance element connected in series with the antenna and a switch connected across the impedance element for selectively short-circuiting the impedance element, with the switch being maintained in a position for short-circuiting the impedance element when the signal generating means is generating the alternating interrogation signal, a marker secured to an article appointed for passage through the interrogation zone, the marker including an amorphous magnetostrictive element and a biasing element mounted adjacent to the magnetostrictive element, the biasing element being magnetically biased to cause the magnetostrictive element to be mechanically resonant in response to the radiated interrogation signal, and detecting circuitry for detecting the mechanical resonance of the magnetostrictive element at times when the signal generating circuit is not generating the alternating interrogation signal.

Further in accordance with this aspect of the invention, the signal generating means may include first and second terminals and there may be first and second transmit antennas connected in parallel between the first and second terminals of the signal generating circuit. If two transmit antennas are present, first and second switchable damping circuits may be provided, with one of the damping circuits connected between the first antenna and the first terminal of the signal generating circuit and the second damping circuit being connected between the second antenna and one of the first and second terminals of the signal generating means. Alternatively, in a case where two transmit antennas are provided, a single damping circuit may be provided within the loop formed by the parallel-connected antennas.

Each of the above-mentioned damping circuits may include a resistor, a field effect transistor switch connected across the resistor, and a series connection of a pair of zener diodes across the resistor.

According to another aspect of the invention, there is provided a method of operating a pulsed-signal magnetomechanical electronic article surveillance system, where the system includes a signal generating circuit for generating an alternating interrogation signal and at least one transmitting antenna connected to the signal generating circuit, and the method includes the steps of providing a switchable damping circuit connected in series with the at least one antenna, operating the signal generating circuit so that the at least one transmitting antenna radiates a pulsed interrogation signal in an interrogation zone, and, in synchronism with desired terminal end points of pulses of the interrogation signal, placing the switchable damping circuit in a state such that the damping circuit provides a damping impedance in series with the at least one antenna.

Further in accordance with this aspect of the invention, and where the EAS system includes two transmitting antennas connected in parallel to form a loop, the providing step includes connecting the switchable damping circuit in series in the loop formed by the two transmitting antennas. Furthermore, the method may also include providing a second switchable damping circuit connected between one of the two transmitting antennas and the signal generating circuit.

Still further, the switchable damping circuit may include an impedance element and an interruptable conductive connection across the impedance element, and the step of placing the switchable damping circuit in the state for providing the damping impedance includes interrupting the interruptable conductive connection across the impedance element. If the interruptable conductive connection includes a switching element, the interrupting of the interruptable conductive connection includes placing the switching element in an open condition.

Providing a switchable damping circuit in series with the transmitting antenna or antennas, and selectively switching a damping impedance into the antenna circuit at times when it is desired to terminate the pulses of the interrogation signal, causes the transmitting antenna or antennas to ring down rapidly, thereby accelerating the time at which is becomes possible to begin to "listen" for the marker signal. As a result, the marker signal, if present, is "listened for" at a time that is earlier in the ring-down of the marker, so that a larger-amplitude marker signal is then present and can be more readily detected.

Also, provision of a switchable damping circuit in a loop formed by parallel-connected transmitting antennas prevents the extended ringing between the antennas that would otherwise occur, thereby making parallel-connected antennas practical for use in pulsed-signal magnetomechanical EAS systems. Consequently, a single transmit circuit can conveniently and efficiently drive one, two or more transmitting antennas, without significant modifications to the transmit circuit.

The foregoing and other objects and features of the invention will be further understood from the following detailed description of preferred embodiments and practices of the invention, and from the drawings, wherein like reference numerals identify like components and parts throughout.

DETAILED DESCRIPTION OF PREFERRED EMBODIMENTS

Figure 1:
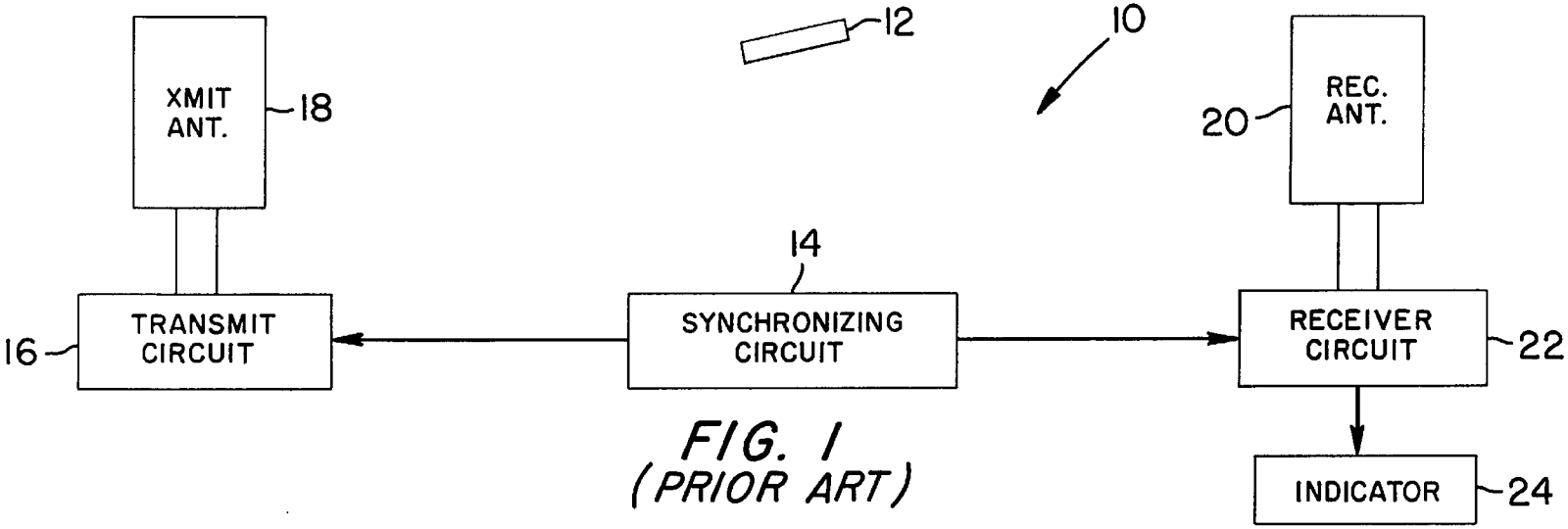
FIG. 1 (PRIOR ART)
FIG. 1 is a block diagram of a pulsed-signal magnetomechanical electronic article surveillance system provided in accordance with the prior art.
Figure 2:
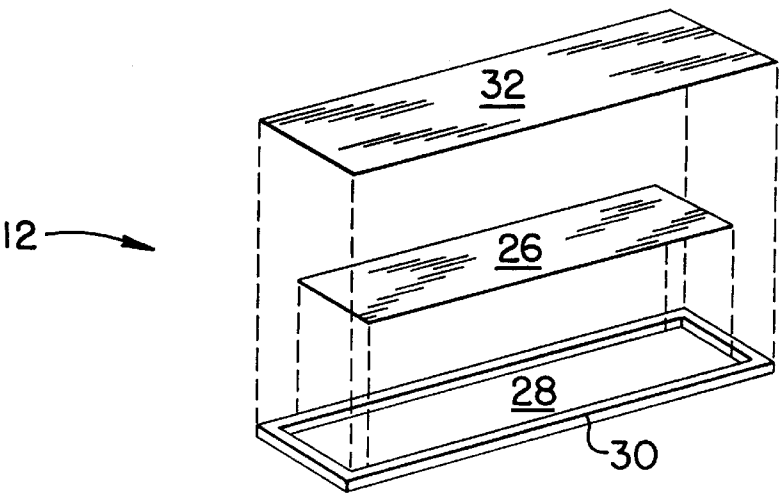
FIG. 2 (PRIOR ART)
FIG. 2 is an isometric view showing components of a conventional marker device used in the magnetomechanical EAS system of FIG. 1.

FIGS. 3A, 3B, 4A and 4B illustrate in schematic block form a portion of the EAS system of FIG. 1, modified in accordance with the invention by incorporation of switchable damping circuits 34-1 and 34-2. In addition, it will be observed that rather than a single transmit antenna 18 as shown in FIG. 1, the modified EAS system illustrated in FIGS. 3A–4B includes a pair of transmit antennas 18-1 and 18-2, connected in parallel between terminals 36-1 and 36-2 of the transmit circuit 16.

Figure 3A:
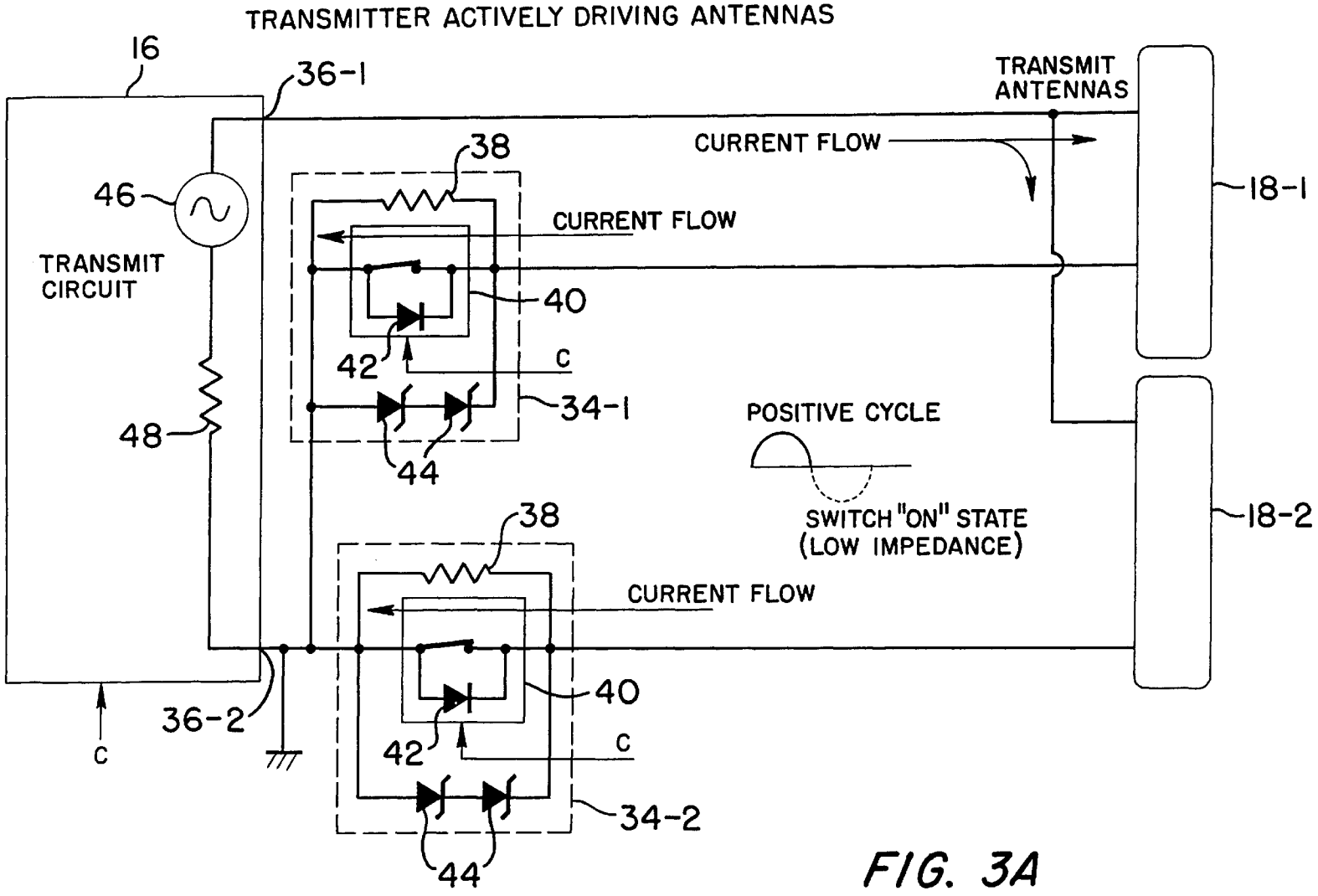
FIGS. 3A, 3B, 4A and 4B illustrate current flow conditions at various times in a portion of the system of FIG. 1, which has been modified in accordance with the invention.
Figure 3B:
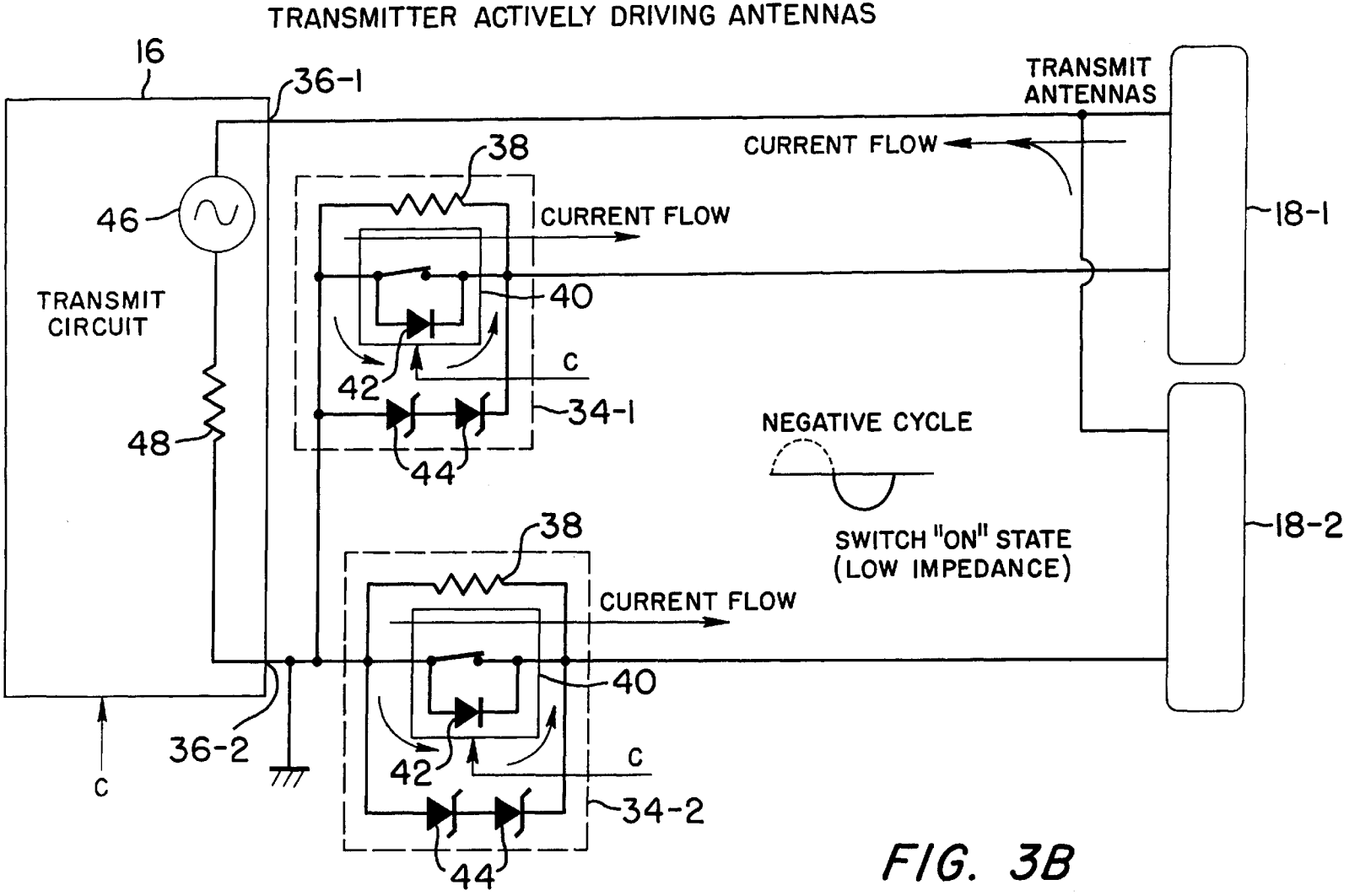
Figure 4A:
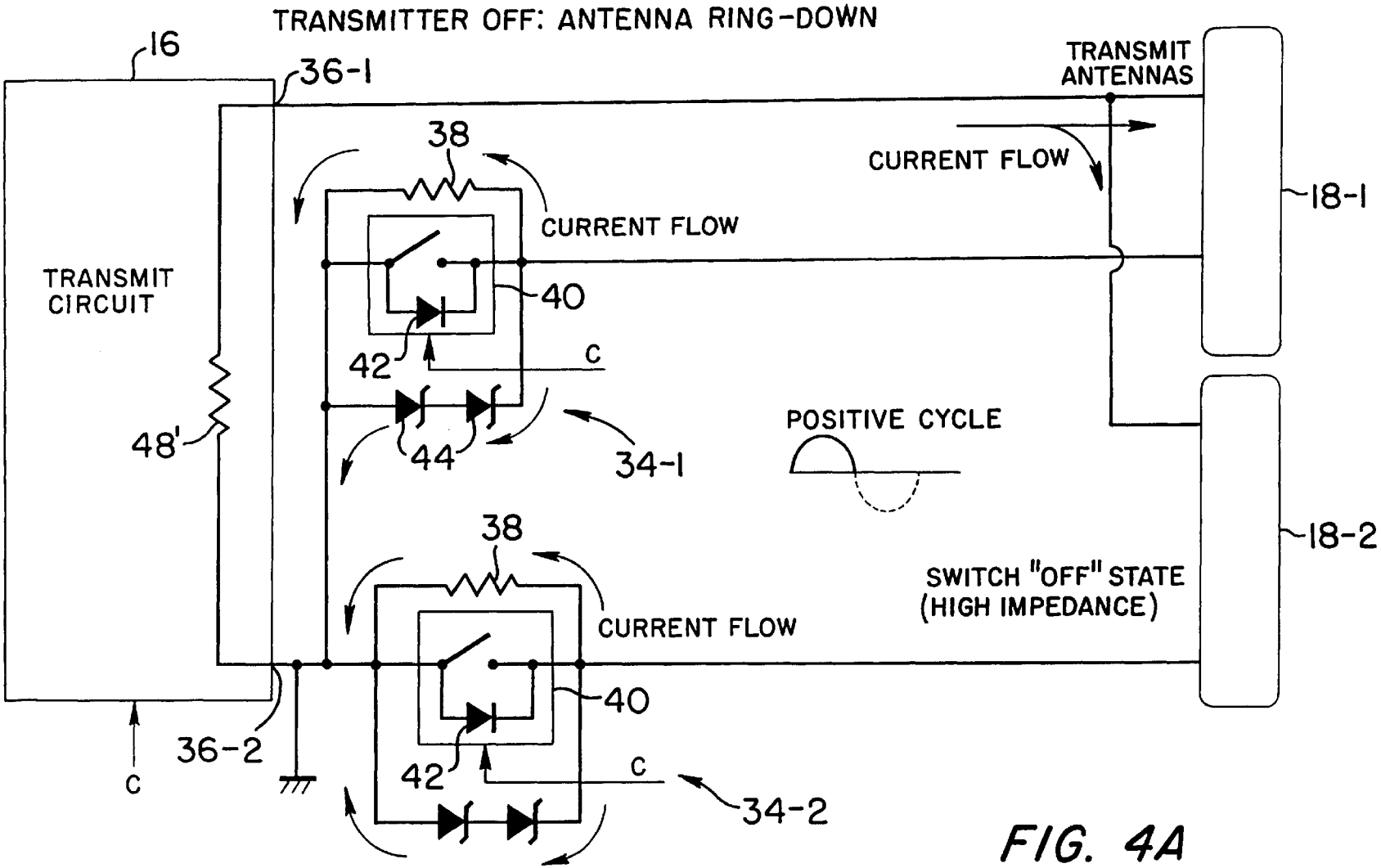
Figure 4B:
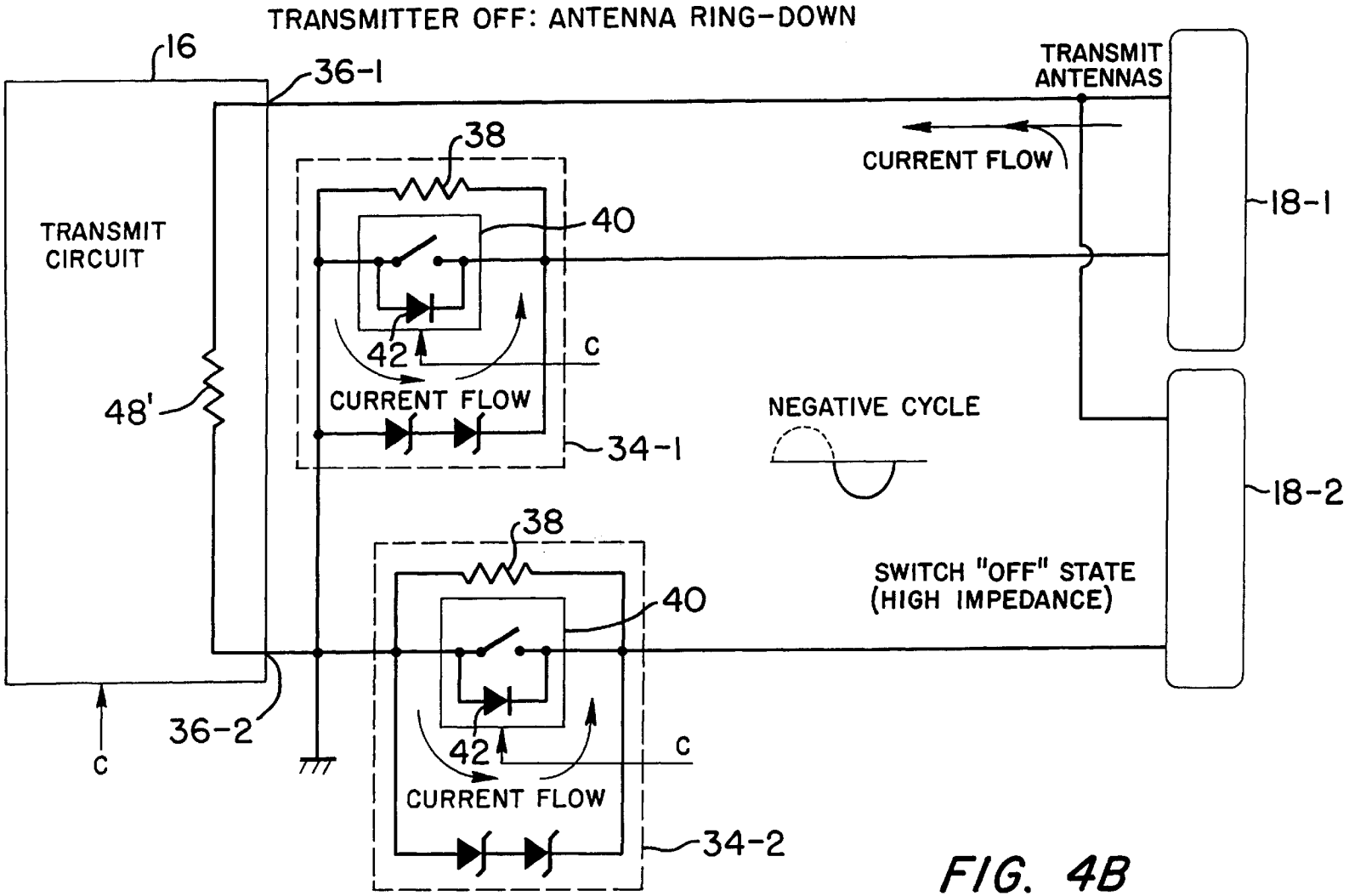

FIGS. 3A and 3B are illustrative of current flow conditions at times when the transmit circuit 16 is generating a signal for driving the transmit antennas 18-1 and 18-2, and FIGS. 4A and 4B illustrate conditions during the "ring-down" which occurs immediately after the transmit circuit stops driving the antennas. FIGS. 3A and 4A illustrate the current flow which takes place during the positive phase of the antenna driving signal and the antenna ring-down, respectively. FIGS. 3B and 4B illustrate the current flow which takes place during the negative phase of the driving signal and the ring-down, respectively.

Each of the damping circuits 34-1, 34-2 includes an impedance 38 connected between a respective one of the transmit antennas 18-1, 18-2 and the terminal 36-2 of the transmit circuit 16. Each impedance 38 may be, for example, a resistor having the value 2.5 kilohms. Also included in each of the switchable damping circuits is a switch 40 connected across the impedance 38. In a preferred embodiment of the invention, the switch 40 is constituted by a field effect transistor of a type suitable for power switching. As is known to those who are skilled in the art, each power FET inherently includes a parasitic diode as indicated at reference numeral 42. Also included in each of the damping circuits are a pair of zener diodes 44, connected in series across the impedance 38.

At times when the transmit circuit 16 is actively driving the antennas, the transmit circuit is equivalent to a sinusoidal signal source 46 and a low impedance 48 in series, as indicated in FIGS. 3A and 3B. When the transmit circuit 16 is no longer driving the antennas, it becomes equivalent to a high impedance 48' (FIGS. 4A and 4B). A control signal C, generated by the synchronizing circuit 14 (FIG. 1), is provided to the transmit circuit 16. The control signal C is pulsed so as to cause the transmit circuit 16 to operate in a pulsed manner as in a conventional pulsed-signal magnetomechanical EAS system. The control signal C is also provided to the FET's 40 of the damping circuits 34-1 and 34-2. In response to the control signal C, the FET's 40 are maintained in a conducting or closed condition when the transmit circuit 16 is driving the antennas, and are placed in an open or non-conducting condition when the transmit circuit 16 is turned off.

When the transmit circuit 16 is driving the transmit antennas, the FET's 40 are maintained in a condition to allow free current flow in both directions, although, as shown in FIG. 3B, during the negative phase of the antenna driving signal a portion of the current flow is attributable to the inherent diode in the FET's . In any event, while the transmit antennas are being driven, the impedances 38 are short-circuited by the FET's 40 and therefore are effectively out of the circuit.

When it is desired to end the driving signal pulse, the transmit circuit 16 is turned off and the FET's 40 are placed in a non-conductive condition. Nevertheless, due to the inherent diode in the FET's , current flow continues through the FET's in the direction indicated in FIG. 4B during the negative phase of the antenna ring-down. However, as indicated in FIG. 4A, during the positive phase of the antenna ring-down the impedances 38 are effectively in the circuit between the antennas 18-1 and 18-2 and the ground-referenced terminal 36-2 of the transmit circuit 16, thereby causing rapid damping of the ring-down signal. It will also be observed that the impedances 38 provide damping in the loop formed by the parallel connection of the transmit antennas. Although the damping provided by the impedances 38 is present only during the positive phase of the ring-down signal, it has been found that the damping effect is nevertheless sufficient to provide very rapid ring-down and satisfactory operation with parallel-connected transmit antennas.

The two zener diodes 44 provided in series across each of the FET's 40 clamp the voltage across the FET's during the first few cycles of the ring-down signal, when the current is relatively high, in order to protect the FET's from exposure to excessive voltage. Although the clamping by the zener diodes limits the effective resistance provided by the impedance 38 during the initial cycles of the ring-down signal, the desired rapid ring-down is still achieved.

It will be understood that switching the impedances 38 into series connection with the transmit antennas at the end of each driving signal pulse promotes rapid ring-down for the transmit antennas, so that the receiver circuitry can be promptly activated to detect the marker signal early during the ring-down of the marker.

Figure 6:
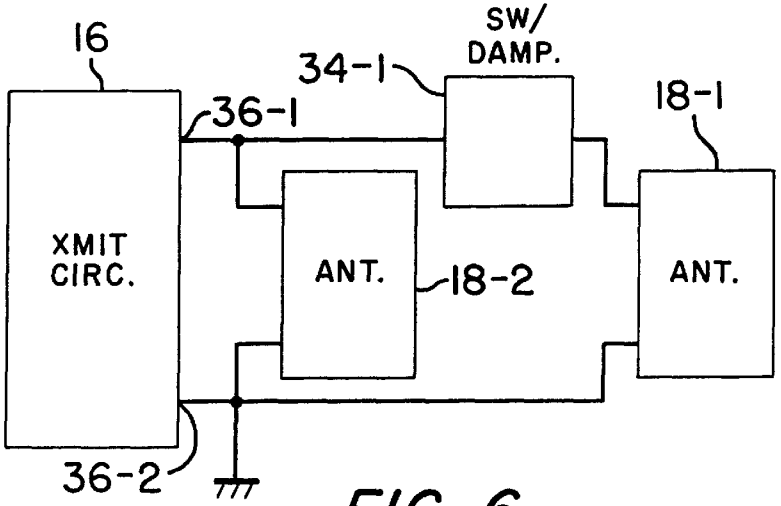
FIGS. 5 and 6 illustrate alternative modifications, in accordance with the invention, of the conventional pulsed-signal magnetomechanical EAS system of FIG. 1.
Figure 5:
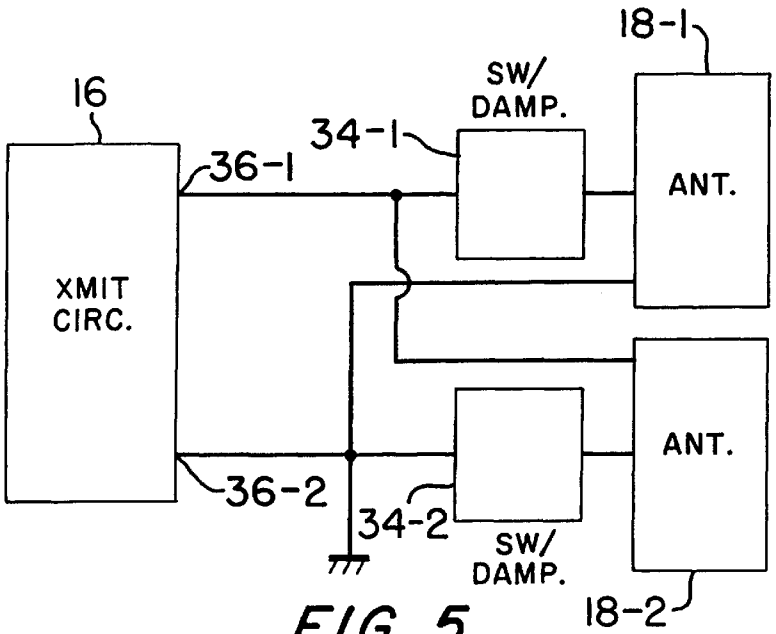

It is contemplated to configure the selectively damped antenna circuitry provided in accordance with the invention in a number of ways. For example, rather than providing both of the switchable damping circuits 34-1, 34-2 at the grounded side of the respective antennas (as in FIGS. 3A–4B), both damping circuits could be provided at the other side of the respective antennas. Alternatively, one damping circuit could be at the grounded side and the other damping circuit at the other side of the respective antennas, as illustrated in FIG. 5. As another alternative, which is illustrated in FIG. 6, one of the damping circuits could be omitted, so that only a single damping circuit is provided in the loop formed by the parallel-connected antennas. It is further contemplated to modify the arrangement shown in FIG. 6 by applying the switchable damping circuit in a case where the transmit circuit 16 drives only one antenna. That is, the antenna 18-2 may be omitted from the arrangement of FIG. 6.

Figure 7:
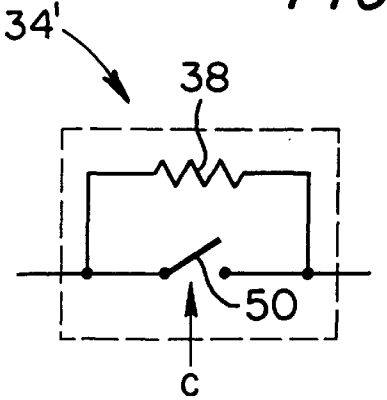

Alternative embodiments of the switchable damping circuit are also contemplated. For example, FIG. 7 illustrates a damping circuit 34' in which a relay 50 is substituted for the FET switch provided in the damping circuits shown in FIGS. 3A–4B. As another alternative, illustrated in FIG. 8, a damping circuit 34" includes a triac 52 as the switching element.

It is to be understood that other types of switching devices besides those mentioned above may be used in the switchable damping circuits.

Figure 8:
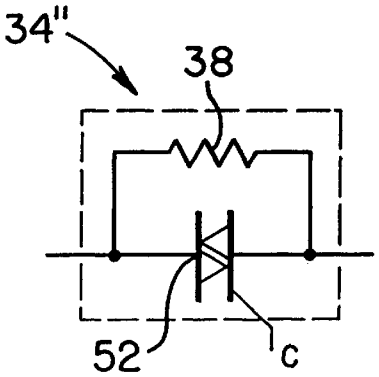
FIGS. 7 and 8 illustrate alternative embodiments of a damping circuit provided in accordance with the invention in the modified EAS systems illustrated in FIGS. 3A–6.

In the alternative damping circuits shown in FIGS. 7 and 8, no zener diodes are required to protect the switching elements. Even where power FET's are used as the switching devices, the operating parameters of the system and the characteristics of the FET's may be such that the FET's provide an inherent zener effect sufficient to permit omission of the zeners shown in FIGS. 3A–4B. Also, when zener diodes are provided, there may be more or fewer than the two series-connected zeners shown in FIGS. 3A–4B.

The switchable damping circuits have been illustrated as being separate components from the transmit circuit and antennas. However, it is contemplated to physically integrate a switchable damping circuit as described above in the same housing with a transmit antenna. A switchable damping circuit to be provided in accordance with the principles of the invention could also be integrated with a transmit circuit, although it should be noted that the damping circuit in this case would not be very useful with parallel-connected transmit antennas unless the transmit circuit were configured so that, upon connecting the antennas to the transmit circuit, the damping circuit is placed within the loop formed by the antennas.

Furthermore, although the embodiments of the invention discussed up to this point have included only one transmit antenna or two antennas connected in parallel, it is also contemplated to employ three or more parallel connected antennas driven by a single transmit circuit. In such cases, a respective damping circuit is provided to damp the loop formed by each pair of antennas. It will be recognized that if N is the number of antennas (N being an integer$\geqq$2), then N−1 switchable damping circuits are required to ensure that there is no undamped loop formed by parallel connected antennas. Alternatively, for N antennas, N or more switchable circuits may be provided.

Various changes to the foregoing EAS system and modifications in the described practices may be introduced without departing from the invention. The particularly preferred methods and apparatus are thus intended in an illustrative and not limiting sense. The true spirit and scope of the invention is set forth in the following claims.

What is claimed is:

1. A signal transmission apparatus for use with a pulsed-signal magnetomechanical electronic article surveillance system, comprising:

signal generating means for selectively generating an alternating interrogation signal;

transmitting antenna means connected to said signal generating means for receiving said alternating interrogation signal and radiating said alternating interrogation signal into an interrogation zone; and switchable damping means connected to said antenna means and including an impedance element connected in series with said antenna means and switching means connected across said impedance element for selectively short-circuiting said impedance element, said switching means being maintained in a position for short-circuiting said impedance element when said signal generating means is generating said alternating interrogation signal.

2. A signal transmission apparatus according to claim 1, wherein said signal generating means includes first and second terminals, and said transmitting antenna means includes first and second transmit antennas connected in parallel between said first and second terminals of said signal generating means.

3. A signal transmission apparatus according to claim 2, wherein said switchable damping means includes:

a first switchable damping circuit including a first resistor connected between said first antenna and said first terminal of said signal generating means, and a first switch connected across said first resistor; and a second switchable damping circuit including a second resistor connected between said second antenna and one of said first and second terminals of said signal generating means, and a second switch connected across said second resistor.

4. A signal transmission apparatus according to claim 3, wherein each of said first and second switches comprises a field effect transistor.

5. A signal transmission apparatus according to claim 4, wherein each of said first and second switchable damping circuits includes a zener diode connected between the respective antenna and the signal generating means.

6. A signal transmission apparatus according to claim 4, wherein each of said first and second switchable damping circuits includes a pair of zener diodes connected in series between the respective antenna and the signal generating means.

7. A signal transmission apparatus according to claim 3, wherein each of said first and second switches comprises a relay.

8. A signal transmission apparatus according to claim 3, wherein each of said first and second switches comprises a triac.

9. A method of operating a pulsed-signal magnetomechanical electronic article surveillance system, the system including a signal generating circuit for generating an alternating interrogation signal and at least one transmitting antenna connected to the signal generating circuit, the method comprising the steps of:

providing a switchable damping circuit connected in series with said at least one antenna;

operating said signal generating circuit so that said at least one transmitting antenna radiates a pulsed interrogation signal in an interrogation zone; and in synchronism with desired terminal end points of pulses of said interrogation signal, placing said switchable damping circuit in a state such that said damping circuit provides a damping impedance in series with said at least one antenna.

10. A method according to claim 9, wherein said electronic article surveillance system includes two transmitting antennas connected in parallel to form a loop, and said providing step includes connecting said switchable damping circuit in series in said loop formed by said two transmitting antennas.

11. A method according to claim 10, wherein said method further includes providing a second switchable damping circuit connected between one of said two transmitting antennas and said signal generating circuit.

12. A method according to claim 9, wherein said switchable damping circuit includes an impedance element and an interruptable conductive connection across said impedance element and said step of placing said switchable damping circuit in said state for providing said damping impedance includes interrupting said interruptable conductive connection across said impedance element.

13. A method according to claim 12, wherein said interruptable conductive connection includes a switching element, and said interrupting of said interruptable conductive connection includes placing said switching element in an open condition.

14. A pulsed-signal magnetomechanical electronic article surveillance system, comprising:

signal generating means for selectively generating an alternating interrogation signal;

transmitting antenna means connected to said signal generating means for receiving said alternating interrogation signal and radiating said alternating interrogation signal into an interrogation zone;

switchable damping means connected to said antenna means and including an impedance element connected in series with said antenna means and switching means connected across said impedance element for selectively short-circuiting said impedance element, said switching means being maintained in a position for short-circuiting said impedance element when said signal generating means is generating said alternating interrogation signal;

a marker secured to an article appointed for passage through said interrogation zone, said marker including an amorphous magnetostrictive element and a biasing element mounted adjacent to said magnetostrictive element, said biasing element being magnetically biased to cause said magnetostrictive element to be mechanically resonant in response to said radiated interrogation signal; and detecting means for detecting said mechanical resonance of said magnetostrictive element at times when said signal generating means is not generating said alternating interrogation signal.

15. An electronic article surveillance system according to claim 14, wherein said signal generating means includes first and second terminals, and said transmitting antenna means includes first and second transmit antennas connected in parallel between said first and second terminals of said signal generating means.

16. An electronic article surveillance system according to claim 15, wherein said switchable damping means includes:

a first switchable damping circuit, including a first resistor connected between said first antenna and said first terminal of said signal generating means, and a first switch connected across said first resistor; and a second switchable damping circuit, including a second resistor connected between said second antenna and one of said first and second terminals of said signal generating means, and a second switch connected across said second resistor.

17. An electronic article surveillance system according to claim 16, wherein each of said first and second switches comprises a field effect transistor.

18. An electronic article surveillance system according to claim 17, wherein each of said first and second switchable damping circuits includes a zener diode connected between the respective antenna and the signal generating means.

19. An electronic article surveillance system according to claim 17, wherein each of said first and second switchable damping circuits includes a pair of zener diodes connected in series between the respective antenna and the signal generating means.

20. An electronic article surveillance system according to claim 16, wherein each of said first and second switches comprises a relay.

21. An electronic article surveillance system according to claim 16, wherein each of said first and second switches comprises a triac.

* * * * *

UNITED STATES PATENT AND TRADEMARK OFFICE

CERTIFICATE OF CORRECTION

PATENT NO. : 5,815,076
DATED : Sep. 29, 1998
INVENTOR(S) : Richard L. Herring

It is certified that error appears in the above-identified patent and that said Letters Patent is hereby corrected as shown below:

Col. 7, line 29, delete "≤" and insert --≥--.

Signed and Sealed this

Twenty-ninth Day of June, 1999

*Attest:*

Q. TODD DICKINSON

*Attesting Officer*

*Acting Commissioner of Patents and Trademarks*